US009683435B2

(12) United States Patent
Gorton et al.

(10) Patent No.: US 9,683,435 B2
(45) Date of Patent: Jun. 20, 2017

(54) SENSOR DEPLOYMENT SYSTEM FOR A WELLBORE AND METHODS OF ASSEMBLING THE SAME

(71) Applicant: General Electric Company, Schenectady, NY (US)

(72) Inventors: Andrew Jacob Gorton, Albany, NY (US); Glen Peter Koste, Niskayuna, NY (US); Mahadevan Balasubramaniam, Ballston Lake, NY (US); Stephen Sanborn, Copake, NY (US)

(73) Assignee: General Electric Company, Niskayuna, NY (US)

( * ) Notice: Subject to any disclaimer, the term of this patent is extended or adjusted under 35 U.S.C. 154(b) by 471 days.

(21) Appl. No.: 14/196,924

(22) Filed: Mar. 4, 2014

(65) Prior Publication Data

US 2015/0252665 A1 Sep. 10, 2015

(51) Int. Cl.

| | |
|---|---|
| ***E21B 47/01*** | (2012.01) |
| ***E21B 47/10*** | (2012.01) |
| ***E21B 33/127*** | (2006.01) |
| ***E21B 49/08*** | (2006.01) |

(52) U.S. Cl.

CPC ..... *E21B 47/01* (2013.01); *E21B 33/127* (2013.01); *E21B 47/10* (2013.01); *E21B 49/08* (2013.01)

(58) Field of Classification Search

CPC ..... E21B 47/01; E21B 47/10; E21B 33/127; E21B 49/08; E21B 23/14; E21B 23/00; E21B 17/1014; E21B 47/011

See application file for complete search history.

(56) References Cited

U.S. PATENT DOCUMENTS

| | | | |
|---|---|---|---|
| 7,617,873 | B2 | 11/2009 | Lovell et al. |
| 8,113,284 | B2 | 2/2012 | Jee et al. |
| 2004/0047534 | A1 | 3/2004 | Shah et al. |
| 2005/0109508 | A1 | 5/2005 | Vella et al. |
| 2007/0007005 | A1 | 1/2007 | Heller et al. |
| 2007/0095528 | A1 | 5/2007 | Ziauddin et al. |
| 2007/0125163 | A1 | 6/2007 | Dria et al. |
| 2007/0186640 | A1 | 8/2007 | Johnson et al. |
| 2007/0215345 | A1 | 9/2007 | Lafferty et al. |
| 2007/0289739 | A1 | 12/2007 | Cooper et al. |
| 2009/0037113 | A1 | 2/2009 | Akram et al. |
| 2009/0218094 | A1 | 9/2009 | McLeod et al. |
| 2010/0082258 | A1 | 4/2010 | Wang |

(Continued)

FOREIGN PATENT DOCUMENTS

| | | | |
|---|---|---|---|
| GB | 2441552 | A | 3/2008 |
| WO | 2010144113 | A2 | 12/2010 |

(Continued)

*Primary Examiner* — Michael Wills, III
(74) *Attorney, Agent, or Firm* — Pabitra K. Chakrabarti

(57) ABSTRACT

A sensor deployment system for positioning within a well casing is provided. The sensor deployment system includes a deployment shuttle comprising a first end, a second end, and an inner surface and an outer surface extending between the first end and the second end. The inner surface is configured to define a channel between the first end and the second end. A sleeve is coupled to the outer surface and configured to move relative to the well casing. A wire support is coupled to the inner surface and extending into the channel.

20 Claims, 11 Drawing Sheets

(56) References Cited

U.S. PATENT DOCUMENTS

| | | | | |
|---|---|---|---|---|
| 2010/0207019 | A1 | 8/2010 | Hartog et al. | |
| 2010/0219334 | A1 | 9/2010 | Legrand et al. | |
| 2010/0242619 | A1 | 9/2010 | Le Blanc et al. | |
| 2011/0048136 | A1 | 3/2011 | Birch et al. | |
| 2011/0214771 | A1 | 9/2011 | Graham | |
| 2011/0226469 | A1 | 9/2011 | Lovell et al. | |
| 2011/0229071 | A1 | 9/2011 | Vincelette et al. | |
| 2011/0292384 | A1 | 12/2011 | Ramos et al. | |
| 2011/0311179 | A1 | 12/2011 | Greenaway | |
| 2012/0006444 | A1 | 1/2012 | Tupper et al. | |
| 2012/0012308 | A1 | 1/2012 | Ziauddin et al. | |
| 2012/0031609 | A1* | 2/2012 | Wheater ..... | E21B 17/10 166/241.5 |
| 2012/0048546 | A1 | 3/2012 | Ndinemenu et al. | |
| 2012/0147924 | A1 | 6/2012 | Hall | |

FOREIGN PATENT DOCUMENTS

| | | | |
|---|---|---|---|
| WO | 2011043768 | A1 | 4/2011 |
| WO | 2011099962 | A1 | 8/2011 |
| WO | 2012059729 | A1 | 5/2012 |
| WO | 2012059736 | A1 | 5/2012 |
| WO | 2013012642 | A2 | 1/2013 |

* cited by examiner

SENSOR DEPLOYMENT SYSTEM FOR A WELLBORE AND METHODS OF ASSEMBLING THE SAME

BACKGROUND

The embodiments described herein relate generally to sensor deployment systems, and more particularly, to methods and systems for deploying sensors for monitoring a stimulation flow and a production flow of fluids within a well casing of a wellbore.

Hydraulic fracturing is a process whereby a subterranean hydrocarbon formation is stimulated to induce a highly conductive path of fluid flow to and from the formation. Typically, a stimulation fluid is pumped at high pressure from a well casing and into the formation to crack the formation, creating larger passageways for hydrocarbon flow. The stimulation fluid may include a proppant, such as sand or other solids that fill the cracks in the formation, so that, when the fracturing treatment is done and the high pressure is released, the fracture remains open. Subsequently, production fluid, such as petroleum, flows from the formation and into the well casing.

Deploying conventional sensors for extended monitoring during hydraulic fracturing and stimulation processes, and during hydrocarbon production may be costly, time consuming and complex—due to sensors and associated communication wires that may require attachment to the well casing before being inserted into the ground. During insertion of the casing, service providers must be careful to not damage the sensors or communication wire. Assuming that the sensors and cables are successfully deployed in the subsurface, the location of the sensors and communication wire may be determined by running a logging tool to map-out the respective sensor locations. Accordingly, a perforation gun can be orientated in such a way that the sensor system is not damaged while creating well casing perforations needed to fracture and produce from the formation. Obtaining down hole data during phases of well completion would be valuable for improving understanding of subsurface behavior such as, for example "sweet spot" or natural fracture locations, cluster-by-cluster fluid flows, stage-by-stage production, treating pressures, and stimulation efficiency. Current challenges, however, may prohibit down hole data collection. Moreover, some current sensor systems are permanently fixed to the casing wall and may not be removed to subsequent production operations and/or for reuse in other wells.

Moreover, during production flow, production fluid enters the well casing via perforations formed in the well casing adjacent the geological formation. Some well assemblies include submergible pumping systems for raising the fluids collected in the well. Some oil and gas wells may provide a high rate of fluid production in the early phase of the well life; and may provide a lower rate of fluid production for the remainder of the well life due to declines in sub-surface pressure and lower levels of available production fluid. Accurate monitoring of the production fluid pressure in the wellbore is also advantageous to efficiently operate pumping systems.

BRIEF DESCRIPTION

In one aspect, a sensor deployment device for positioning within a well casing is provided. The sensor deployment device includes a deployment shuttle comprising a first end, a second end, and an inner surface and an outer surface extending between the first end and the second end. The inner surface is configured to define a channel between the first end and the second end. A sleeve is coupled to the outer surface and configured to move relative to the well casing. A wire support is coupled to the inner surface and extending into the channel.

In another aspect, a sensor deployment system for monitoring a fluid flowing within a well casing is provided. The sensor deployment system includes a deployment shuttle having a first end, a second end, and an inner surface and an outer surface extending between the first end and the second end. The inner surface is configured to define a channel between the first end and the second end. A wire support is coupled to the inner surface. A sensor is coupled to the wire support and configured to sense at least one characteristic of the fluid flowing within the well casing.

In a further aspect, a method of manufacturing a sensor deployment system for a well casing is provided. The method includes stabilizing a deployment shuttle having an inner surface, an outer surface, and channel defined by the inner surface. The method includes coupling a sleeve to the outer surface, where the sleeve is configured to move relative to the well casing. Moreover, the method includes coupling a wire support to the inner surface and extending the wire support within the channel.

DRAWINGS

These and other features, aspects, and advantages will become better understood when the following detailed description is read with reference to the accompanying drawings in which like characters represent like parts throughout the drawings, where:

Figure 1:
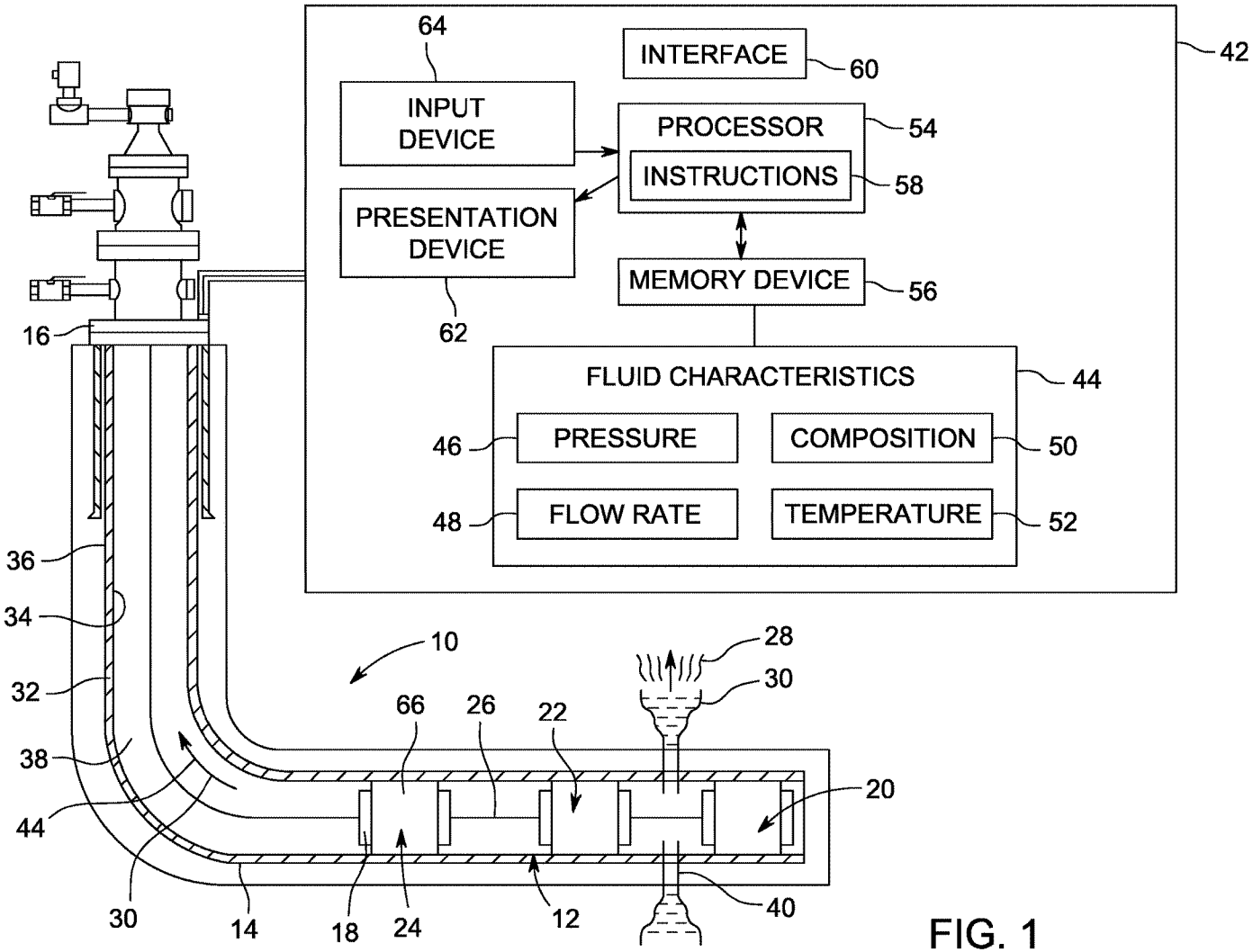
FIG. 1 is a cross-sectional side view of a well assembly having an exemplary sensor deployment system coupled to a wellbore via a wellhead.
Figure 7:
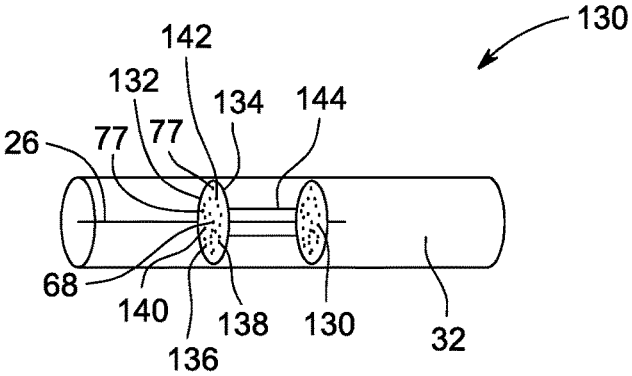
Figure 8:
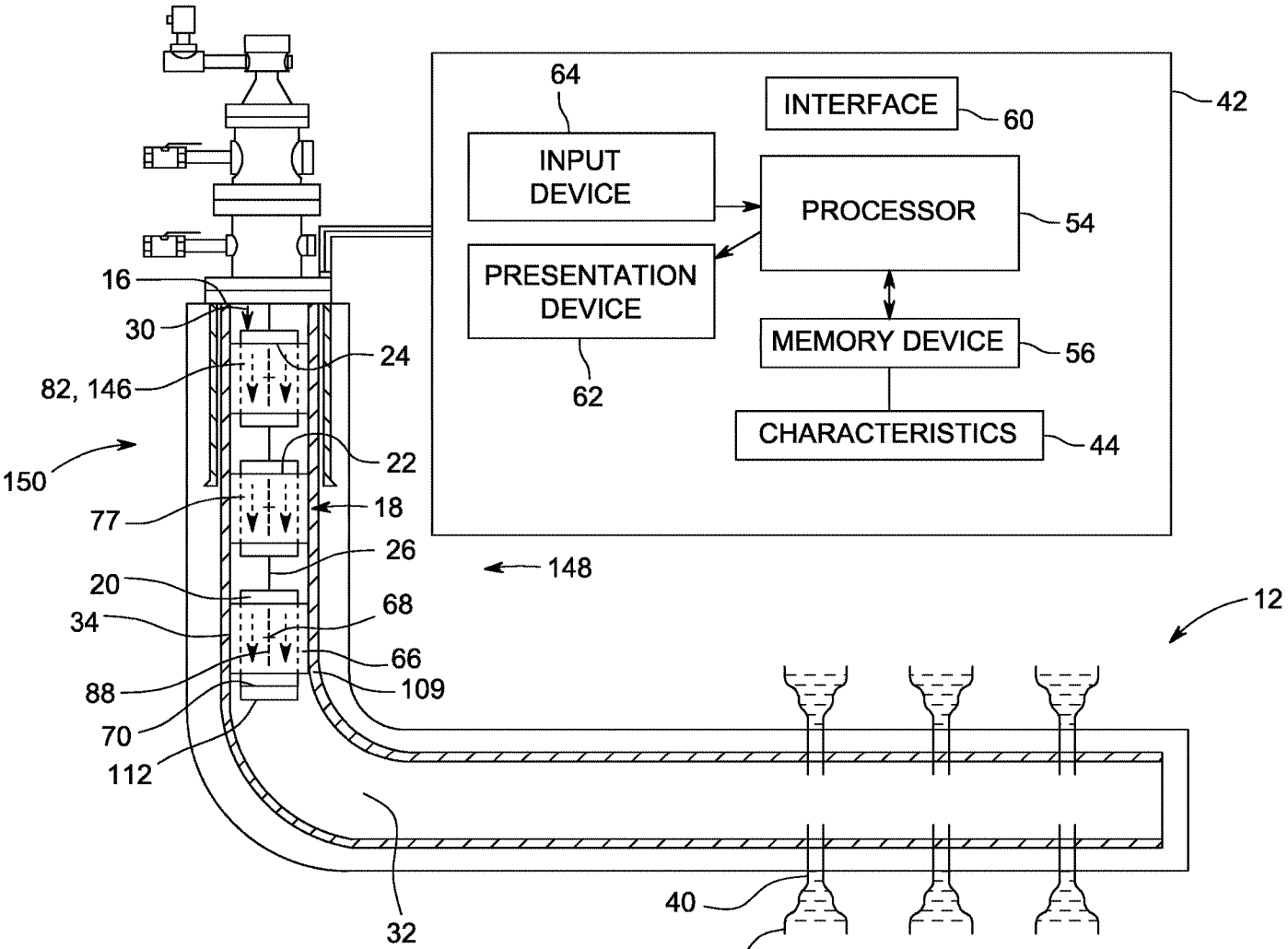
Figure 9:
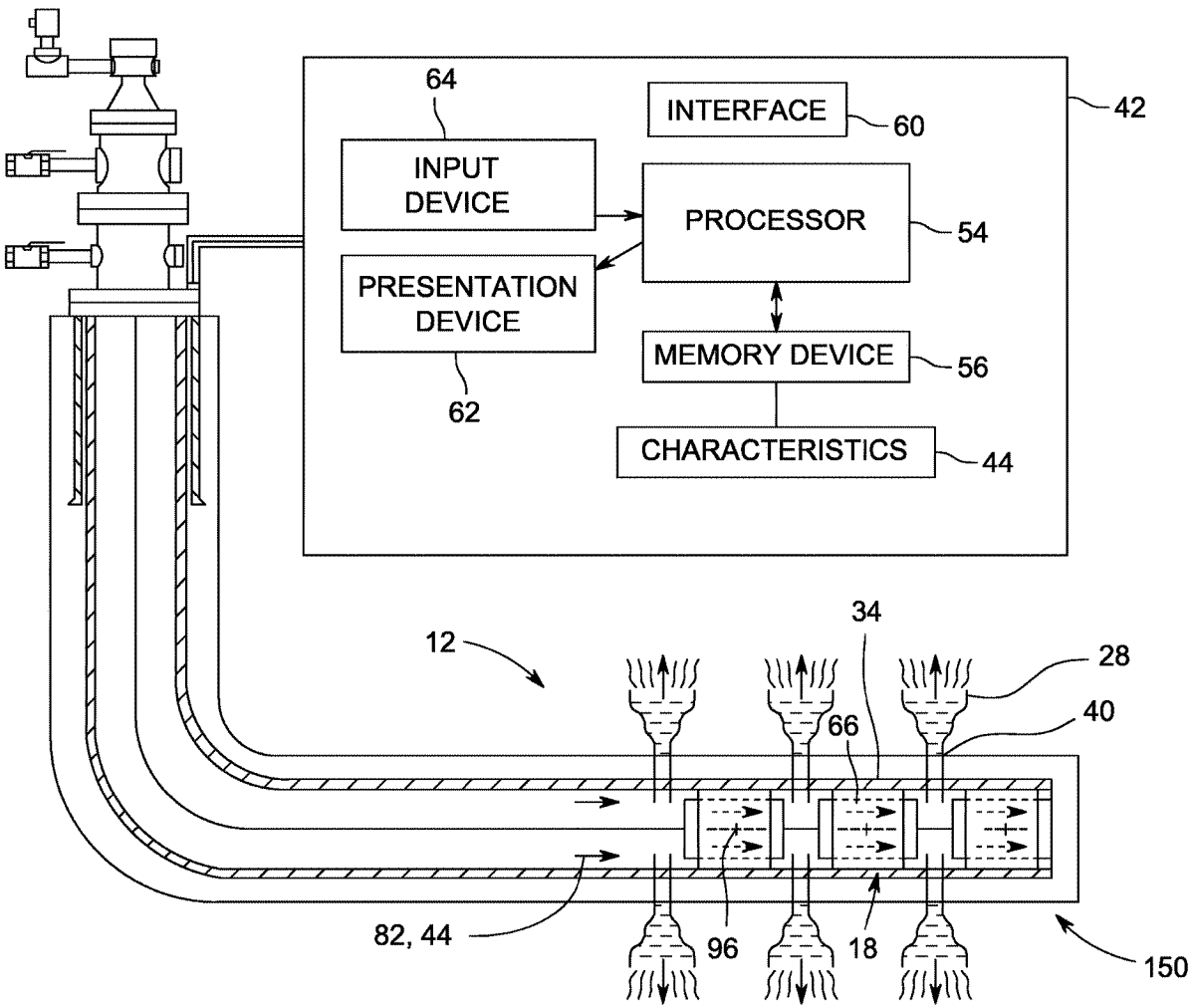
Figure 10:
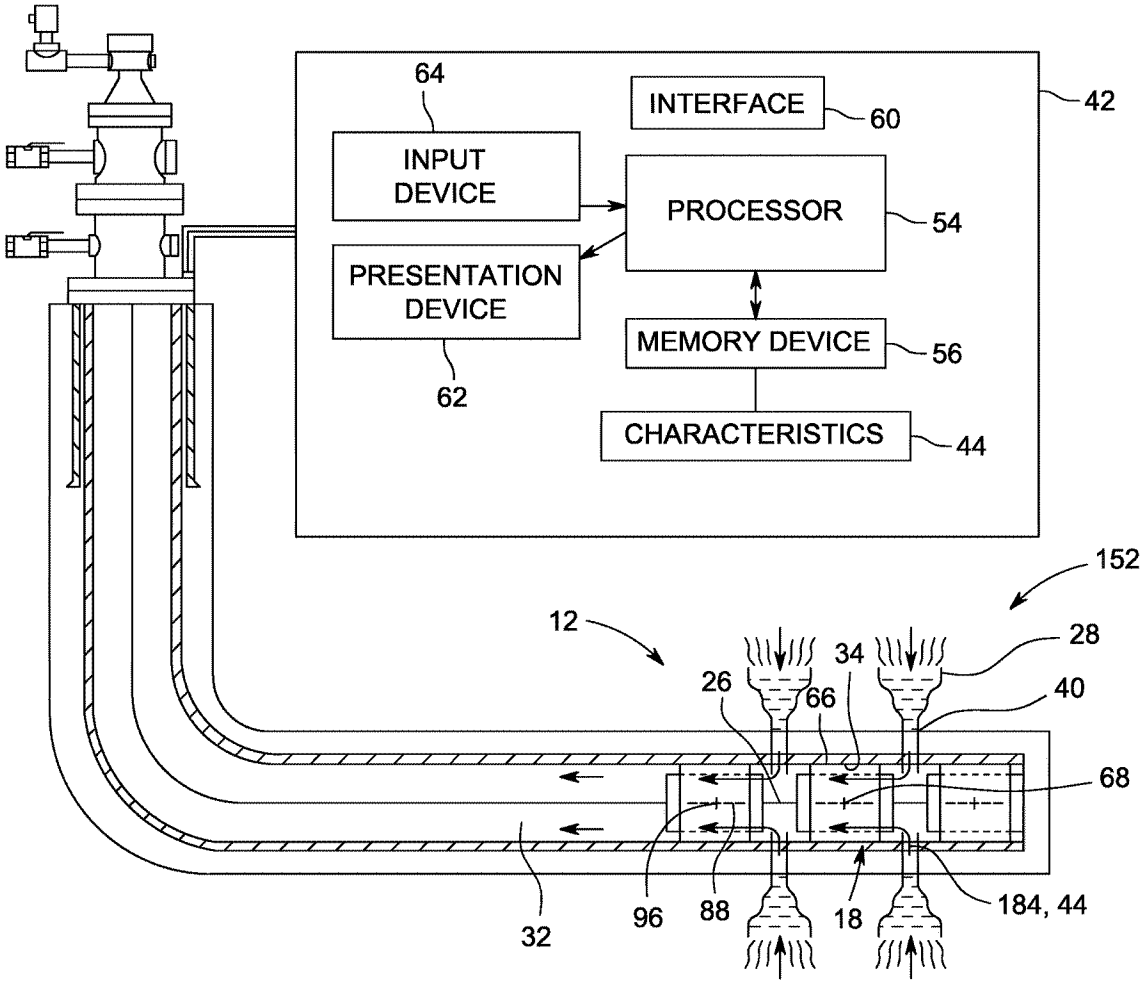
Figure 11:
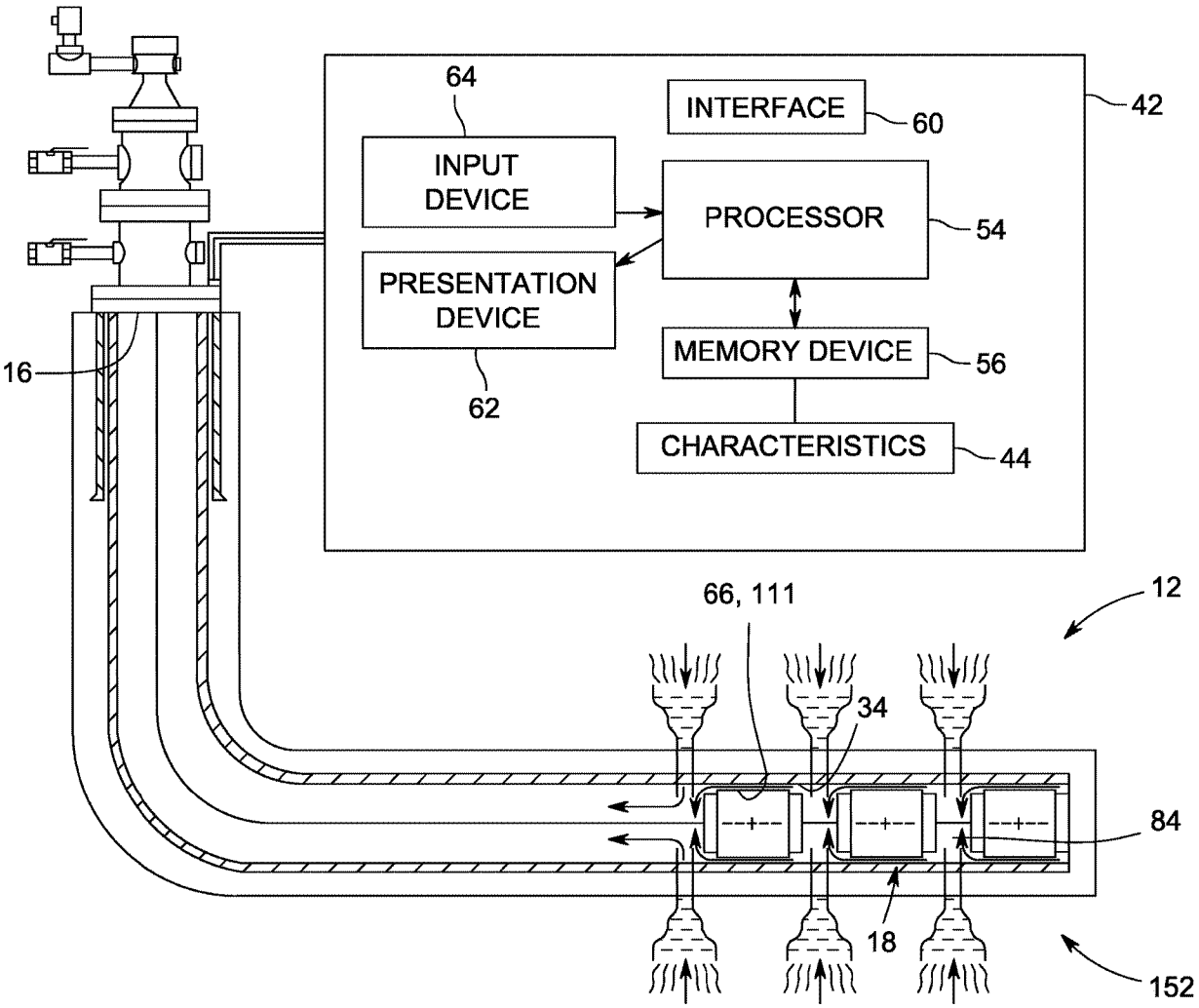
Figure 12:
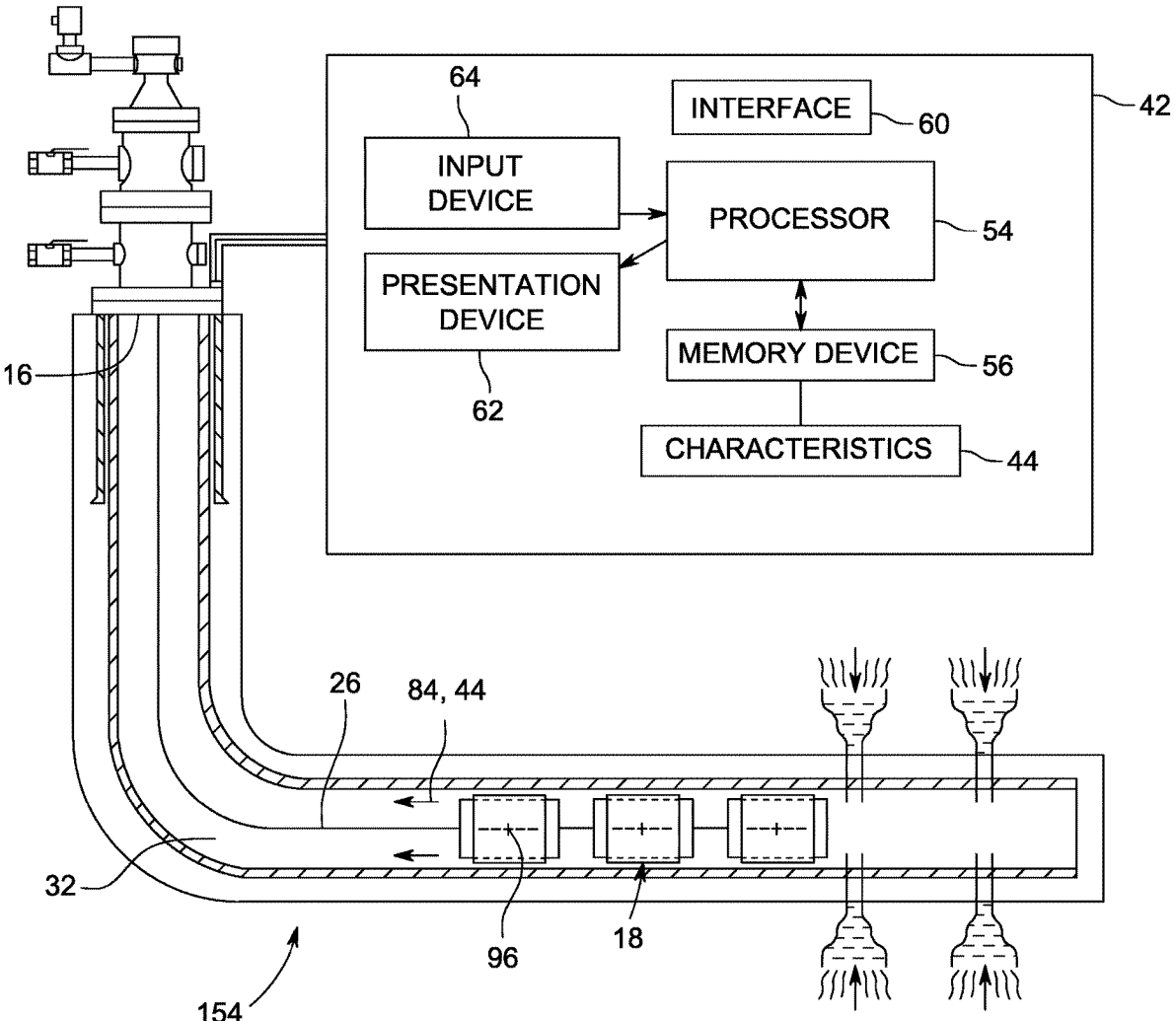
Figure 13:
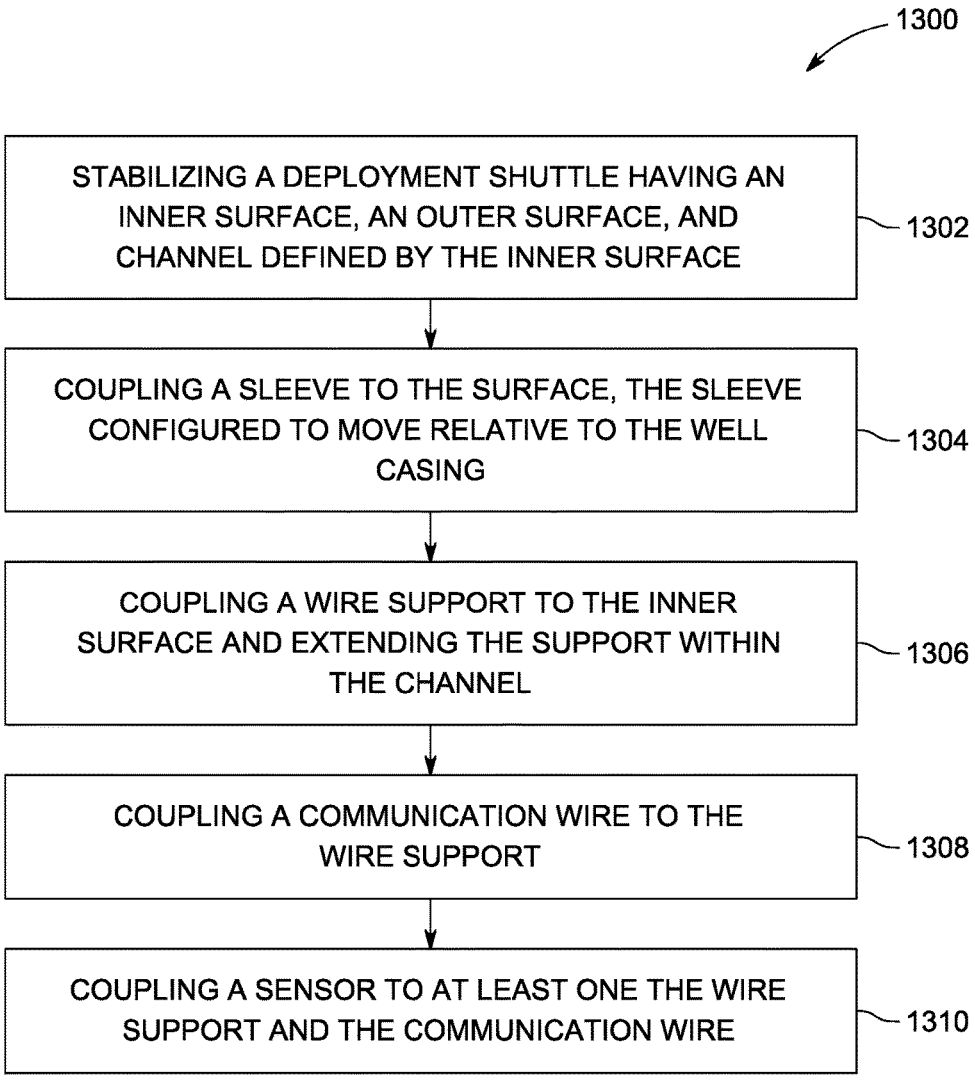

FIG. 6*a* is a side elevational view of another exemplary deployment shuttle that may be used with the sensor deployment system shown in FIG. 1;

FIG. 7 is a side elevational view of another exemplary deployment device that may be used with the sensor deployment system shown in FIG. 1;

FIG. 8 is a side elevational view of the sensor deployment system during an initial stage of operation;

FIG. 9 is a side elevational view of the sensor deployment system shown in FIG. 1 during a stimulation stage of operation;

FIG. 10 is a side elevational view of the sensor deployment system shown in FIG. 1 during a production stage of operation;

FIG. 11 is a side elevational view of a plurality of deployment shuttles shown in FIG. 1 during the production stage and the sleeve positioned in the second position;

FIG. 12 is a side elevational view of the plurality of deployment shuttles shown in FIG. 1 during a retraction stage of operation; and FIG. 13 is a flowchart illustrating an exemplary method of assembling sensor deployment system shown in FIG. 1 to a well casing.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings. The singular forms "a", "an", and "the" include plural references unless the context clearly dictates otherwise. "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a system modified by a term or terms, such as "about" and "substantially", are not to be limited to the precise system specified. Here and throughout the specification and claims, range limitations may be combined and/or interchanged, such ranges are identified and include all the sub-ranges contained therein unless context or language indicates otherwise.

As used herein, the term "computer" and related terms, e.g., "computing device", are not limited to integrated circuits referred to in the art as a computer, but broadly refers to a microcontroller, a microcomputer, a programmable logic controller (PLC), an application specific integrated circuit, and other programmable circuits, and these terms are used interchangeably herein. Further, as used herein, the terms "software" and "firmware" are interchangeable, and include any computer program stored in memory for execution by personal computers, workstations, clients and servers.

As used herein, the term "non-transitory computer-readable media" is intended to be representative of any tangible computer-based device implemented in any method or technology for short-term and long-term storage of information, such as, computer-readable instructions, data structures, program modules and sub-modules, or other data in any device. Therefore, the methods described herein may be encoded as executable instructions embodied in a tangible, non-transitory, computer readable medium, including, without limitation, a storage device and/or a memory device. Such instructions, when executed by a processor, cause the processor to perform at least a portion of the methods described herein. Moreover, as used herein, the term "non-transitory computer-readable media" includes all tangible, computer-readable media, including, without limitation, non-transitory computer storage devices, including, without limitation, volatile and nonvolatile media, and removable and non-removable media such as a firmware, physical and virtual storage, CD-ROMs, DVDs, and any other digital source such as a network or the Internet, as well as yet to be developed digital means, with the sole exception being a transitory, propagating signal.

The embodiments described herein relate to systems and methods for monitoring a stimulation flow and a production flow of fluids within a well casing of a wellbore. The embodiments also relate to methods, systems, and/or apparatus for deploying sensors and monitoring fluid characteristics to facilitate improvement of well production performance. More particularly, the embodiments described herein enhance knowledge of sub-surface behavior of a geological formation. It should be understood that the embodiments described herein include a variety of types of well assemblies, and further understood that the descriptions and figures that utilize hydrocarbon formations are exemplary only. The exemplary sensor deployment system is configured to position sensors within a wellbore, where the sensors measure, collect, and/or report fluid data and system data during hydraulic stimulation and/or hydraulic production.

Figure 2:
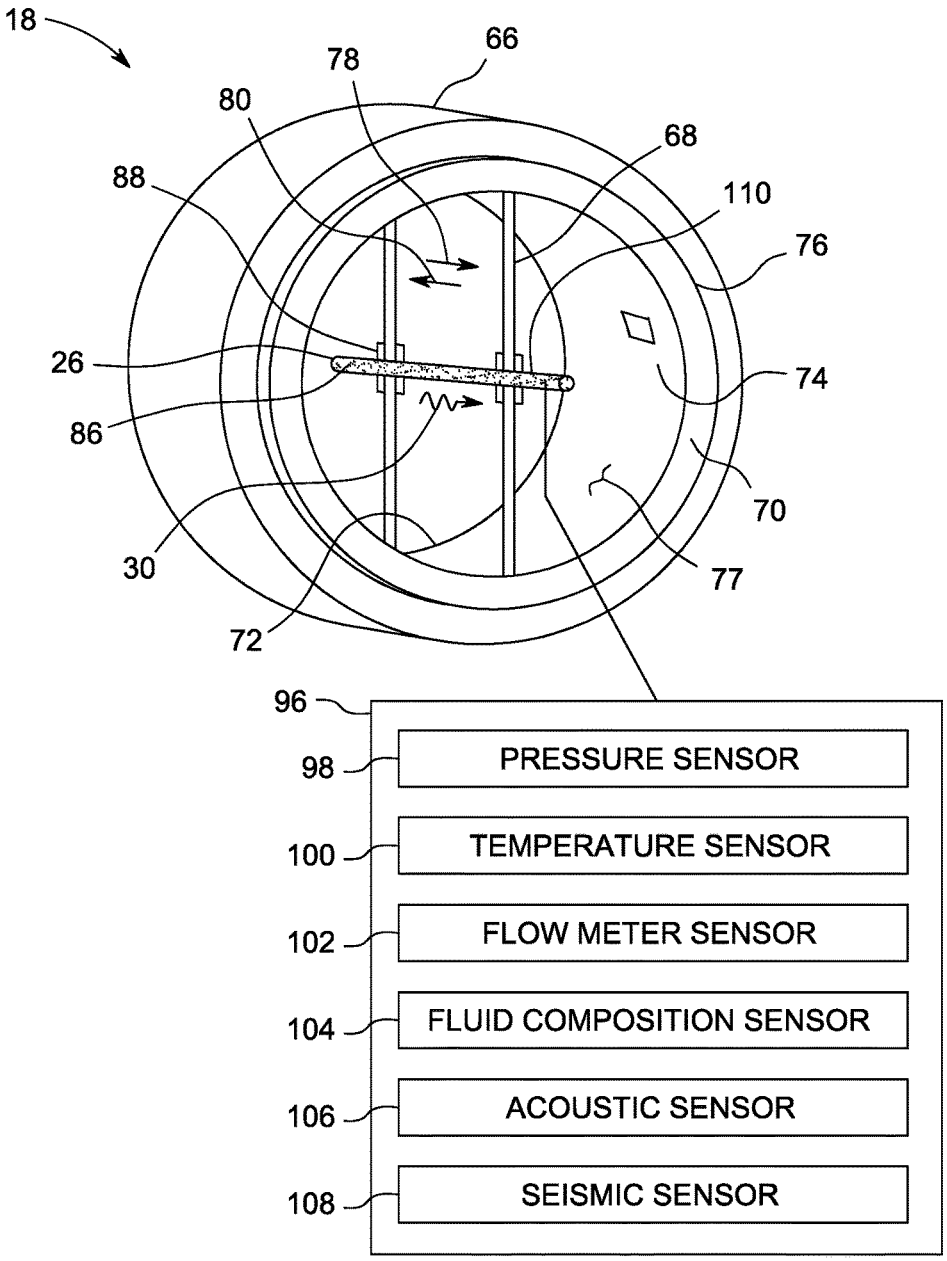
FIG. 2 is a perspective view of an exemplary deployment shuttle of the sensor deployment system shown in FIG. 1.

FIG. 1 is a cross-sectional side view of a well assembly 10 having an exemplary sensor deployment system 12 coupled to a wellbore 14 via a wellhead 16. FIG. 2 is a perspective view of a deployment shuttle 18 of sensor deployment system 12 (shown in FIG. 1). Sensor deployment system 12 includes a plurality of deployment shuttles 18 such as, for example, a first deployment shuttle 20, an intermediate deployment shuttle 22, and a last deployment shuttle 24. Alternatively, the plurality of deployment shuttles 18 can include less than or more than three deployment shuttles 18. Moreover, intermediate deployment shuttle 22 can include any number of deployment shuttles 18. A communication wire 26 is coupled to each deployment shuttle 18. Sensor deployment system 12 is configured to insert, in a plurality of positions, within wellbore 14 which is associated with a geological formation 28 containing desirable production fluid 30, such as, but not limited to, petroleum. Wellbore 14 is drilled into geological formation 28 and lined with a well casing 32. Well casing 32 includes an inner sidewall 34, an outer sidewall 36, and a casing bore 38 defined by inner sidewall 34. Well casing 32 may be positioned in any orientation within geological formation 28 to enable sensor deployment system 12 to function as described herein. A plurality of perforations 40 is formed through well casing 32 to permit fluid 30 to flow from geological formation 28 and into well casing 32.

Sensor deployment system 12 is coupled, via communication wire 26, to a computing device 42 for use in analyzing fluid characteristics 44 such as, but not limited to, pressures 46, flow rates 48, fluid compositions 50, temperatures 52, and in particular, fluid characteristics 44 relating to a stimulation fluid 82 (shown in FIGS. 8 and 9) and/or a production fluid 84 (shown in FIGS. 10 and 11). Computing device 42 is also configured to analyze strains applied to sensor deployment system 12 during operations. Computing device 42 includes a processor 54 and a memory 56. Processor 54 includes a processing unit, such as, without limitation, an integrated circuit (IC), an application specific integrated circuit (ASIC), a microcomputer, a programmable logic controller (PLC), and/or any other programmable circuit. Processor 54 may include multiple processing units (e.g., in a multi-core configuration). Computing device 42 is configurable to perform the operations described herein by programming processor 54. For example, processor 54 may be programmed by encoding an operation as one or more executable instructions and providing the executable instructions to processor 54 in memory 56 coupled to processor 54. Memory 56 includes, without limitation, one or more random access memory (RAM) devices, one or more storage devices, and/or one or more computer readable media. Memory 56 is configured to store data, such as computer-executable instructions. Memory 56 includes any device allowing information 58, such as executable instructions and/or other data, to be stored and retrieved.

Stored in memory 56 are, for example, presentation readable instructions for providing a user interface 60 to a user (not shown), via a presentation device 62, receiving and processing input from an input device 64. User interface 60 may include, among other possibilities, a web browser and/or a client application. Web browsers and client applications enable users to display and interact with media and other information. Exemplary client applications include, without limitation, a software application for managing one or more computing devices 42.

Computing device 42 includes at least one presentation device 62 for presenting information to user. Presentation device 62 is any component capable of conveying information to user. Presentation device 62 includes, without limitation, a display device (not shown) (e.g., a liquid crystal display (LCD), organic light emitting diode (OLED) display, or "electronic ink" display) and/or an audio output device (e.g., a speaker or headphones). Presentation device 62 includes an output adapter (not shown), such as a video adapter and/or an audio adapter. Output adapter is operatively coupled to processor 54 and configured to be operatively coupled to an output device (not shown), such as a display device or an audio output device.

Moreover, computing device 42 includes input device 64 for receiving input from user. Input device 64 includes, for example, a keyboard, a pointing device, a mouse, a stylus, a touch sensitive panel (e.g., a touch pad or a touch screen), a gyroscope, an accelerometer, a position detector, and/or an audio input device. A single component, such as a touch screen, may function as both an output device of presentation device 62 and input device 64. Computing device 42 can be communicatively coupled to a network (not shown).

Sensor deployment system 12 includes a sleeve 66, a wire support 68, and a sensor 96 coupled to each deployment shuttle 18. In the exemplary embodiment, each deployment shuttle 18 includes a first end 70, a second end 72, and an inner surface 74 and an outer surface 76 extending between first end 70 and second end 72. Inner surface 74 defines a channel 77 between first end 70 and second end 72. In the exemplary embodiment, deployment shuttle 18 is tubular shaped. Alternatively, deployment shuttle 18 may include other shapes such as, but not limited to, triangular, octagonal, and square shapes. Deployment shuttle 18 can include any shape to enable sensor deployment system 12 to function as described herein. Deployment shuttle 18 is configured to allow flow of fluid 30 in a first direction 78 and in an opposite direction 80 within channel 77. Deployment shuttle 18 includes a material composition such as, but not limited to steel, aluminum, metal alloys, carbon fibers, stainless steel, chromium, and ceramics which can withstand harsh environments such as, but not limited to, pitting, corrosion, and chloride stress cracking within well casing 32.

Wire support 68 is coupled to inner surface 74 and extends at least partially into channel 77. In the exemplary embodiment, wire support 68 is configured to extend across channel 77. Wire support 68 includes a configuration such as, for example, a rod, a fin, and a bracket. Wire support 68 may include any configuration to facilitate flow of fluid 30 within channel 77 while reducing a pressure loss of fluid 30. Moreover, wire support 68 is configured to withstand fluid characteristics 44. Alternatively, wire support 68 wire can be coupled to first end 70, second end 72, and outer surface 76.

In the exemplary embodiment, wire support 68 is coupled to communication wire 26. More particularly, wire support 68 is configured to couple to communication wire 26 and suspend sensor 96 within channel 77. Communication wire 26 may include a coating 86 that is configured to withstand harsh environments present within well casing 32. In the exemplary embodiment, communication wire 26 includes a fiber optic cable having microstructures (not shown) and/or porous fibers (not shown) which are configured to compress when responding to external pressures. Alternatively, communication wire 26 can include other types of distributed fiber-optic based sensors configured to measure temperature (DTS), acoustic (DAS), fluid composition, fluid flow, and/or strain. Communication wire 26 is configured to transmit signals relating to fluid characteristics 44 to computing device 42 as described herein. Moreover, communication wire 26 is configured to couple to the plurality deployment shuttles 18, via wire supports 68, to pull subsequent deployment shuttles 18 within well casing 32 as described herein. Accordingly, as described herein, communication wire 26 is configured to withstand strain loads applied by pulling deployment shuttles 18.

In the exemplary embodiment, a rotation device 88 such as, for example high load roller bearings and/or journal bearings, is coupled to wire support 68 and communication wire 26. Alternatively, rotation device 88 may include any smooth bearing surface and separate axial restraint configuration (not shown). In an alternative embodiment, wire support 68 and communication wire 26 are coupled together and rotate together with respect to deployment shuttle 18. Rotation device 88 can include any configuration to allow deployment shuttle 18 and/or communication wire 26 to rotate within channel 77 while immobilizing wire support 68 within channel 77. More particularly, rotation device 88 facilitates rotational movement experienced by deployment shuttles 18 and/or communication wire 26 while under an influence of fluid 30 moving within well casing 32 to reduce and/or eliminate entanglement of communication wire 26. Moreover, rotation device 88 facilitates wire support 68 to remain fixed within channel 77. In an alternative embodiment, a rigid support (not shown) may couple adjacent shuttles 18 together. Rigid support is configured to reduce and/or eliminate rotation of adjacent of adjacent shuttles 18 with respect to each other. Moreover, rigid support is flexible to move adjacent shuttles 18 around a corner or bend of well casing 32.

Sensor deployment system 12 further includes fluid sensor 96 coupled to communication wire 26. In the fluid embodiment, fluid sensor 96 is embedded within communication wire 26. Alternatively, sensor 96 may couple to wire support 68 and/or to inner surface 74. Fluid sensor 96 can couple to any portion of deployment shuttle 18 to enable sensor deployment system 12 to function as described herein. Fluid sensor 96 is configured to sense, monitor, record, and/or transmit fluid characteristics 44 present within fluid 30 to computing device 42. In the exemplary embodiment, fluid sensor 96 includes at least one of a pressure sensor 98, a temperature sensor 100, a flow sensor 102, a fluid composition sensor 104, an acoustic sensor 106, and a seismic sensor 108. Still further, sensor 96 can includes a plurality of "single-point" sensors that are fiber-optic and/or electronic coupled to at least one of shuttles 18, sleeve, 66, and wire support 68 and send data via communication wire 26 to computing device 42. Fluid sensor 96 can include any configuration to sense characteristics 44 of fluid 30. Moreover, a strain sensor 110 is coupled to and/or embedded within communication wire 26. Strain sensor 110 is configured to sense, monitor, record, and/or transmit strain that is applied by deployment shuttles 18 to communication wire 26 and to computing device 42. Moreover, strain sensor 110 is configured to report imposed strains to computing device 42. Alternatively, strain sensor 110 can couple to at least one of deployment shuttle 18, sleeve 66, and well casing 32 to sense, monitor, record, and/or transmit strains applied at least one of deployment shuttle 18, sleeve 66, and well casing 32. Moreover, strain sensor 110 can measure strains applied to deployment shuttles 18 as a result of strains and/or pressures present in well casing 32 and/or formation 30.

Figure 3:
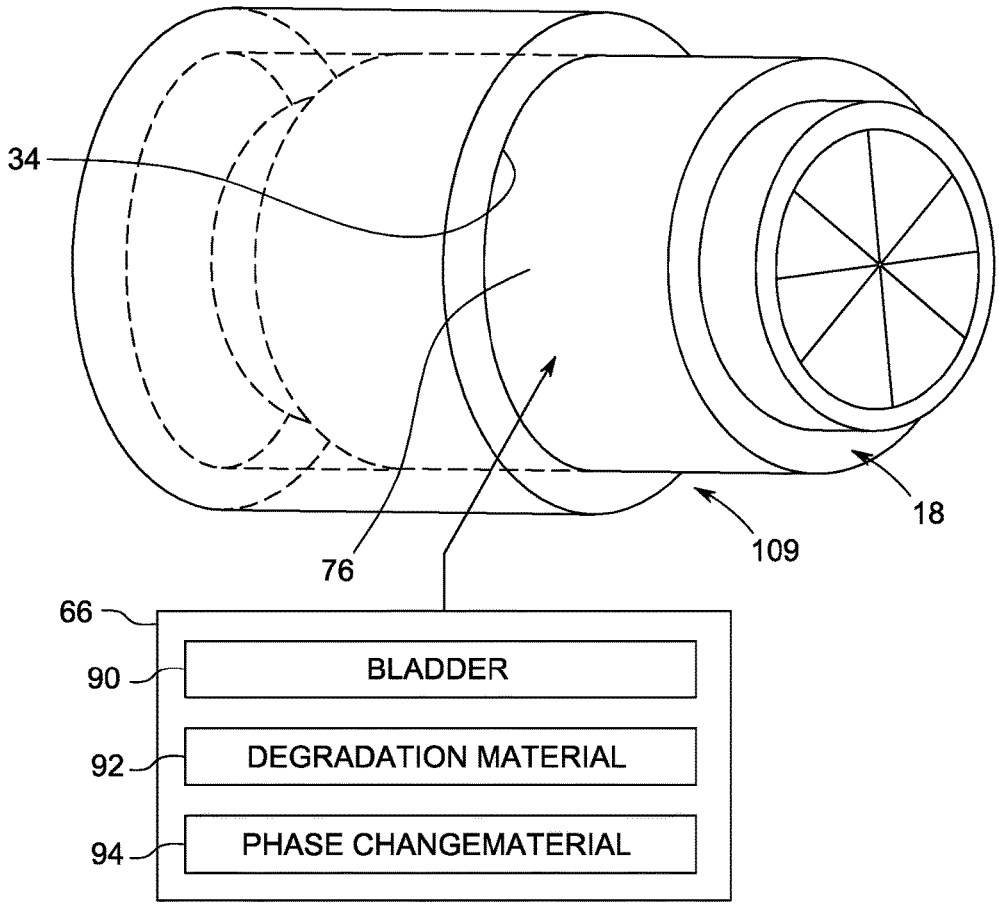
FIG. 3 is a perspective view of a sleeve of the deployment shuttle shown in FIG. 2 in a first position.
Figure 4:
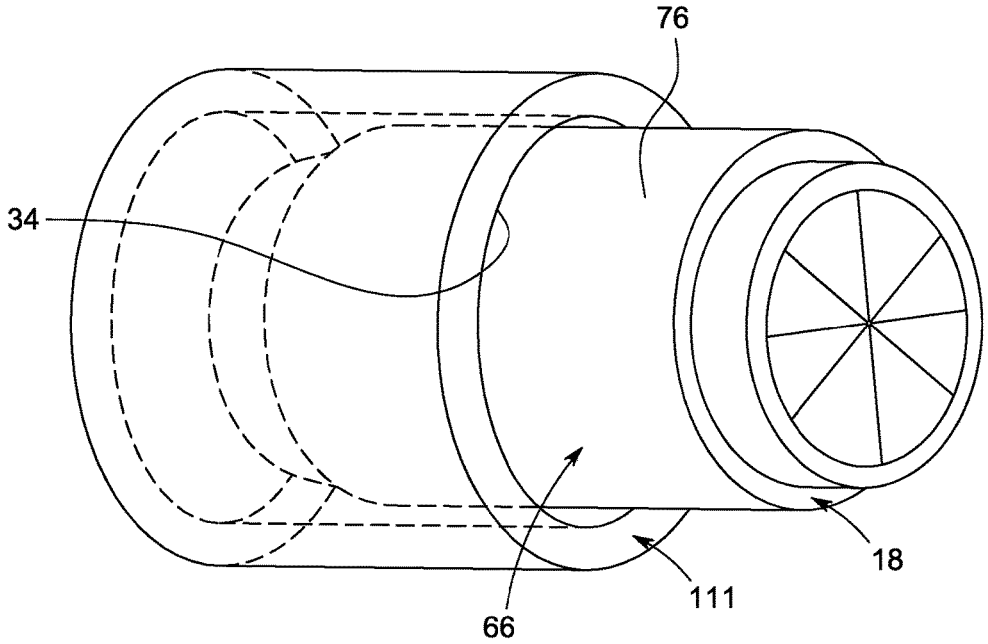
FIG. 4 is another perspective view of the sleeve shown in FIG. 2 in a second position.

FIG. 3 illustrates a perspective view of sleeve 66 in a first position 109 and coupled to inner sidewall 34 of well casing 32 and outer surface 76 of deployment shuttle 18. FIG. 4 illustrates another perspective view of sleeve 66 in a second position 111 and decoupled from inner sidewall 34 while remaining coupled to outer surface 76. Individual sleeves 66 may be selectively positioned in first position 109 and/or second position 111. Computing device 42 can selectively position sleeve 66 in first position 109 and/or second position 111 in response to at least strains, pressures, and/or other parameters applied to sensor deployment system 12. More particularly, computing device 42 may electronically and/or wirelessly selectively actuate sleeve 66 to move between first position 109 and second position 111. In the exemplary embodiment, sleeve 66 is configured to expand to first position 109 to friction fit against inner sidewall 34. Moreover, sleeve 66 is configured to retract to second position 111 to separate and release from inner sidewall 34. Sleeve 66 includes at least one of a bladder 90, a chemical degradation material 92, and a phase change material 94. Alternatively, sleeve 66 may include any inflatable and/or swell able material and/or any electrically and/or manually driven device activated by computing device 42 via communication wire 26. Sleeve 66 is configured in first position 109 during insertion of the plurality deployment shuttles 18 as described herein. Additionally, sleeve 66 is configured in first position 109 during stimulation and/or production of well casing 32 as described herein. In first position 109, sleeve 66 is configured to stabilize support 68 and sensor 96 coupled thereto to facilitate measurements by sensor 96. Moreover, first position 109 facilitates sensor 96 measuring seismic, micro seismic and other phenomena within formation 30. Moreover, sleeve 66 is configured to second position 111 during retraction of deployment shuttles 18 out of well casing 32 as described herein.

In the exemplary embodiment, bladder 90 can expand into first position 109 by inflating bladder 90 with a fluid such as, but not limited to, air (not shown), stimulation fluid 82 (shown in FIG. 9), and production fluid 84 (shown in FIG. 10). Bladder 90 can retract to second position 111 by deflating bladder 90. Moreover, chemical degradation material 92 can be formed to first position 109 and chemically degrade over time to second position 111. Still further, phase change material 94 can be formed to first position 109 and retract to second position 111 based on exposures to characteristics such as, but not limited to, pressures, temperatures, electricity and composition of fluid 30.

In the exemplary embodiment, an end cover 112 is coupled to at least one of first end 70 and second end 72. End cover 112 is configured to seal first end 70 and/or second end 72 and contact fluid 30 that is present within channel 77. As described herein, a fluid pressure 146 (shown in FIG. 8) is configured to press against end cover 112 to facilitate moving the plurality deployment shuttles 18 within well casing 32. In the exemplary embodiment, end cover 112 is coupled to first end 70 of first deployment shuttle 18. Alternatively, end cover 112 can be selectively coupled to at least one of a first deployment shuttle 20, intermediate deployment shuttle 22, and last deployment shuttle 24. End cover 112 is configured to include an aperture, channel, and/or flow path (none shown) to facilitate flow of fluid 30 through end cover 112.

Figure 5:
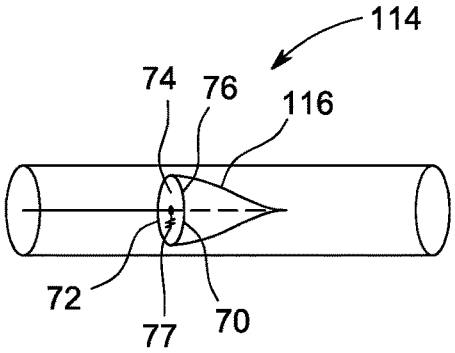
FIG. 5 is a side elevational view of another exemplary deployment shuttle that may be used with the sensor deployment system shown in FIG. 1.

FIG. 5 is a side elevational view of another deployment shuttle 114. In FIG. 5, similar components have the same element numbers as components shown in FIGS. 1-4. Deployment of shuttle 114 includes first end 70, second end 72, and inner surface 74 and outer surface 76 extending between first end 70 and second end 72. Inner surface 74 defines channel 77. An end cover 116 is coupled to first end 70 and coupled to communication wire 26. In the exemplary embodiment, end cover 116 includes an aerodynamic shape such as, but not limited to, a tear drop shape, a cone shape, and a pointed shape. End cover 116 facilitates aerodynamically moving deployment shuttle 114 within fluid 30 present within well casing 32.

Figure 6:
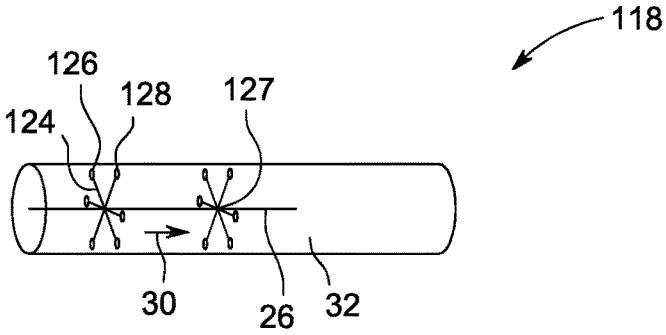
FIG. 6 is a side elevational view of another exemplary deployment shuttle that may be used with the sensor deployment system shown in FIG. 1.

FIG. 6 is a side elevational view of another deployment shuttle 118. In FIG. 6, similar components have the same element numbers as component shown in FIGS. 1-5. In the exemplary embodiment, deployment shuttle 118 includes a plurality of inner surfaces 124, and a plurality of outer surfaces 126. Each outer surface 126 is coupled to a respective inner surface 124. In the exemplary embodiment, outer surface 126 includes a pressure surface 128 such as, but not limited to, a fin, a vane, and a paddle. Pressure surface 128 is configured to receive fluid 30 flowing within well casing 32 to facilitate moving deployment shuttle 118 within wellbore 14. Pressure surface 128 is sized and shaped to provide maximum surface area while minimizing pressure losses of fluid 30 flowing within well casing 32.

Deployment shuttle 118 includes a wire support 127 coupled to communication wire 26. In an alternative embodiment, inner surfaces 124 and outer surfaces 126 may initially be retracted in a position near communication wire 26. In response to pressures within well casing 32 and/or electrical signals (not shown) generated by computing device 42, inner surfaces 124 and outer surfaces 126 may extend outwardly to position pressure surfaces 128 adjacent to inner sidewall 34 to expose pressure surface 128 to flow of fluid 30. Inner surfaces 124 and outer surfaces 126 can automatically expand based on pressures within well casing 32. Alternatively, computing device 42 may actuate inner surfaces 124 and outer surfaces 126 to expand based on pressures within well casing 32. Accordingly, pressure surfaces 128 can be adjustable to accommodate and/or adjust pressures within fluid 30. In the exemplary embodiment, deployment shuttle 118 is configured to rotate about communication wire 26 under an influence of fluid 30 flowing within well casing 32. Another deployment shuttle 118 is coupled to deployment shuttle 118 by a rigid support 144. Rigid support 144 is configured to stabilize the pair of deployment shuttles 118 upright with well casing 32.

FIG. **6*a* is a side elevational view of another deployment shuttle 120. In FIG. 6*a*, similar components have the same element numbers as component shown in FIGS. 1-6. In the exemplary embodiment, deployment shuttle 118 includes the plurality of inner surfaces 124, and the plurality of outer surfaces 126. Each outer surface 126 is coupled to a respective inner surface 124. In the exemplary embodiment, outer surface 126 includes pressure surface 128 such as, but not limited to, a blade. Pressure surface 128 is configured to receive fluid 30 flowing within well casing 32 to facilitate moving deployment shuttle 120 within well casing 32. Pressure surface 128 is sized and shaped to provide maximum surface area while minimizing pressure losses of fluid 30 flowing within well casing 32. Deployment shuttle 120 includes a wire support 121 coupled to communication wire 26. In the exemplary embodiment, deployment shuttle 120 is configured to rotate about communication wire 26 under an influence of fluid 30 flowing within well casing 32. Another deployment shuttle 120 is coupled to deployment shuttle 130 by rigid support 144. Rigid support 144 is configured to stabilize the pair of deployment shuttles 120 upright with well casing 32**.

FIG. 7 is a side elevational view of another deployment shuttle 130. In FIG. 7, similar components have the same element numbers has component shown in FIGS. 1-6*a*. Deployment shuttle 130 includes a first end 132, a second end 134, an inner surface 136 and an outer surface 138. In the exemplary embodiment, channel 77 includes a plurality of channels 140 positioned through first end 132 and second end 134 to form a perforated plate 142. Deployment shuttle 130 includes wire support 68 coupled to the communication wire 26 via a bearing (not shown). In the exemplary embodiment, deployment shuttle 130 is configured to rotate about communication wire 26 under an influence of fluid 30 flowing within well casing 32. Another deployment shuttle 130 is coupled to deployment shuttle 130 by rigid support 144. Rigid support 144 is configured to stabilize the pair of deployment shuttles 130 upright with well casing 32.

FIG. 8 illustrates a side elevational view of sensor deployment system 12 during an initial stage 148 of operation. FIG. 9 is a side elevation view of sensor deployment system 12 during a stimulation stage 150 of operation. During an exemplary operation of sensor deployment system 12, the plurality of deployment shuttles 18 are positioned through wellhead 16 and into well casing 32. In the exemplary embodiment, first deployment shuttle 20 is positioned in a lead position with subsequent deployment shuttles 18 such as intermediate deployment shuttle 22 and last deployment shuttle 24 trailing behind first deployment shuttle 20. First deployment shuttle 20 includes end cover 112 coupled to first end 70. Since communication wire 26 couples to each wire support 68, the plurality deployment shuttles 18 are coupled to each other. Moreover, in the exemplary embodiment, sleeves 66 are expanded to first position 109 to couple to inner sidewall 34 while the plurality of deployment shuttles 18 are placed within well casing 32.

During an initial stage 148, fluid 30 such as a carrier fluid 83, for example water, is pumped from wellhead 16 and into well casing 32. Since sleeve 66 is frictionally fit against inner sidewall 34 in first position 109, sleeve 66 seals inner sidewall 34 so that carrier fluid 83 flows through respective channels 77 of last deployment shuttle 24 and intermediate deployment shuttle 22. Carrier fluid 83 flows beyond intermediate deployment shuttle 22 and into channel 77 of first deployment shuttle 20. Carrier fluid 83 flows through channel 77 of first deployment shuttle 20 and against end cover 112.

Pressure 146 of carrier fluid 83 against end cover 112 is configured to push or move first deployment shuttle 20 within well casing 32 and toward perforations 40. More particularly, pressure 146 overcomes the frictional interface between sleeve 66 and inner sidewall 34 to move first deployment shuttle 20 to stimulation stage 150 near perforations 40. Since communication wire 26 couples intermediate deployment shuttle 22 and last deployment shuttle 24 to first deployment shuttle 20, first deployment shuttle 20 pulls intermediate deployment shuttle 22 and last deployment shuttle 24 within well casing 32 and toward perforations 40. In an exemplary embodiment, sleeves 66 of first deployment shuttle 20, intermediate shuttle 22, and last deployment shuttle 24 are positioned in first position 109. Alternatively, at least one of first deployment shuttle 20, intermediate shuttle 22, and last deployment shuttle 24 can be positioned in first position 109 and other deployment shuttles 18 selectively positioned in second position 111 to facilitate moving the plurality of shuttles 18 within well casing 32.

While carrier fluid 83 moves the plurality deployment shuttles 18, rotation device 88 allows the plurality of deployment shuttles 18 and/or communication wire 26 to rotate, under influence of carrier fluid 82, with respect to fixed wire support 68. Accordingly, rotation device 88 facilitates minimizing and/or eliminating entanglement of communication wire 26 due to flow of carrier fluid 83 and/or rotation of the plurality of deployment shuttles 18. Moreover, the size, shape, and orientation of communication wire 26 and wire support 68 facilitate minimizing pressure loss of carrier fluid 83 flowing through each channel 77 to enhance stimulation processes. Strain sensor 110 is configured to measure and/or report strains applied to at least one of communication wire 26, deployment shuttles 18, and sleeves 66 to computing device 42. Computing device 42 is configured to adjust control flow of carrier fluid 83 based on strains and/or pressures applied to at least one of communication wire 26, deployment shuttles 18, and sleeves 66. Alternatively, computing device 42 can determine if any deployment shuttle 18 is stuck within well casing 32 based on strains and/or pressures applied to at least one of communication wire 26, deployment shuttles 18, and sleeves 66. Additionally, computing device 42 is configured to selectively control any sleeve 66 of the plurality of deployment shuttles 18 to move between first position 109 and second position 111 based on strains and/or pressures applied to at least one of communication wire 26, deployment shuttles 18, and sleeves 66. Sleeves 66 are selectively controlled by computing device 42 to move between first position 109 and second position 111 to adjust the friction with respect to well casing 32 to facilitate movement of the plurality of deployment shuttles 18 within well casing 32.

When the plurality of deployment shuttles 18 are moved to stimulation stage 150, stimulation fluid 82 flows from well head 16 and through channels 77. Stimulation fluid 82 continues to flow through perforations 40 and into geological formation 28 to conduct fracturing operations. During fracturing operations, sensors 96 are configured to measure fluid characteristics 44 of stimulation fluid 82 such as, but not limited to fluid pressure 46, fluid flow rate 48, fluid composition 50, fluid temperature 52, acoustical readings, and seismic activities. Sensors 96 are configured to transmit the measured fluid characteristics 44 of stimulation fluid 82 through communication wire 26 and to computing device 42 for storage, analysis, and/or reporting. During stimulation stage 150, sleeve 66 is configured to frictionally fit against inner sidewall 34 to facilitate stabilizing the plurality deployment shuttles 18 during flow of stimulation fluid 82 through each channel 77. Accordingly, sleeve 66 facilitates steadying sensor 96 within channel 77 to enhance sensor readings of fluid characteristics 44 during stimulation stage 150.

FIG. 10 illustrates a side elevational view of sensor deployment system 12 during a production stage 152. During production stage 152, production fluid 84 flows from geological formation 28, through perforations 40, and into well casing 32. Production fluid 84 continues to flow through each channel 77 and across each sensor 96. During production stage 152, sensors 96 are configured to measure fluid characteristics 44 of production fluid 84 such as, but not limited to, fluid pressure 46, fluid flow rates 48, fluid composition 50, fluid temperature 52, acoustical readings, and seismic activities. Sensors 96 are configured to transmit the measured fluid characteristics 44 of production fluid 84 through communication wire 26 and to computing device 42 for storage, analysis, and/or reporting. The size, shape, and orientation of communication wire 26 and wire support 68 facilitates minimizing pressure loss of production fluid 84 flowing through each channel 77 to enhance production operations. During production stage 152, sleeve 66 is configured to frictionally fit against inner sidewall 34 to facilitate stabilizing the plurality deployment shuttles 18 during flow production fluid 84. Accordingly, sleeve 66 facilitates steadying sensors 96 within each channel to enhance sensor readings of fluid characteristics 44 during production stage 152.

FIG. 11 illustrates a side elevational view of the plurality of deployment shuttles 18 during stimulation stage 150 and/or production stage 152 and sleeves 66 positioned in second position 111. Toward the end of stimulation stage 150 and/or production stage 152, sleeves 66 are configured to retract from first position 109 (shown in FIG. 10) to second position 111 and decouple from inner sidewall 34. In the exemplary embodiment, sleeve 66 includes chemical degradation material 92 which decomposes over a period of predetermined time to retract to second position 111. In another exemplary embodiment, sleeve 66 includes bladder 90 which deflates at a predetermined time period and/or under command by computing device 42 to retract to second position 111. Moreover, in another exemplary embodiment, sleeve 66 includes phase change material 94 which changes shape over a predetermined time period and/or under command by computing device 42 to retract to second position 111. When sleeve 66 retracts to second position 111, stimulation fluid 82 and/or production fluid 84 continues to flow through channel 77 and toward wellhead 16. Stimulation fluid 82 and/or production fluid 84 also flow between sleeve 66 and inner sidewall 34 and toward wellhead 16.

FIG. 12 illustrates a side elevational view of deployment shuttles 18 during a retraction stage 154. After and/or during stimulation stage 150 and/or production stage 152, communication wire 26 is pulled through well casing 32 and toward wellhead 16. The communication wire 26 continues to pull the plurality deployment shuttles 18 through well casing 32 and eventually out of wellhead 16. During retraction stage 154, sensors 96 can continue to monitor and transmit measurements relating to fluid characteristics 44 of stimulation fluid 82 and/or production fluid 84 to computing device 42. Moreover, strain sensor 110 is configured to measure and report to computing device 42 strains applied to communication wire 26 during retraction stage 154. Accordingly, computing device 42 can adjust the rate of retracting the communication wire 26 based on the measured strains.

In an alternative embodiment, the plurality deployment shuttles 18 are positioned within well casing 32 without sleeve 66. In another alternative embodiment, a tubing channel (not shown) can sleeve through channel, couple to deployment shuttles 18, and push and/or pull deployment shuttles 18 within the well casing 32. Moreover, in another alternative embodiment, subsequent production stage 152, sensors 96 and/or communication wire 26 may detach from the plurality of deployment shuttles 18 and be pulled out of well casing 32 for reuse. The remaining deployment shuttles 18 can be drilled out of well casing 32 by standard drill rig.

Still further, in an alternative embodiment, deployment shuttles 114, 118, and/or 130 can be intermediately and selectively coupled to the plurality of deployment shuttles 18 to facilitate increasing surface area expose to fluid pressure 146 to enhance movement of the plurality of deployment shuttles 18 within well casing 32. Computing device 142 can move and/or reconfigure the positions of deployment shuttles 114, 118, and/or 130 within well casing 32 to adjust the flow of fluid 30 based on at least strain measurements provided by strain sensor 110.

FIG. 13 is a flowchart illustrating an exemplary method 1300 of assembling a sensor deployment system, such as sensor deployment system 12 (shown in FIG. 1), to well casing 32 (shown in FIG. 1). Method 1300 includes stabilizing 1302 a deployment shuttle, such as deployment shuttle 18 (shown in FIG. 3). The deployment shuttle includes inner surface, outer surface, and channel 77 defined by inner surface (all shown in FIG. 3). Method 1300 includes coupling 1304 sleeve 66 (shown in FIG. 3) to the outer surface. The sleeve is configured to move relative to the well casing. In the exemplary method 1300, wire support 68 is coupled 1306 to inner surface and extends within channel. Method 1300 includes coupling 1308 communication wire 26 (shown in FIG. 3) to the wire support. Moreover, in the exemplary method 1300, rotation device 88 (shown in FIG. 3) is coupled to the wire support and the communication wire. Sensor 96 (shown in FIG. 3) is coupled 1310 to at least one of the wire support and the communication wire. Moreover, method 1300 includes coupling end cover 112 (shown in FIG. 4) to the deployment shuttle.

The exemplary embodiments described herein provide for a deployment system for cost effective positioning of deployment shuttles and associated sensors for sensing and transmitting fluid characteristics from a well. The exemplary embodiments describe a deployment system that enables the deployment of individual sensors or wire-sensor systems in oil and gas wells for extended periods of time during hydraulic stimulation and also during hydrocarbon production without the need to attach the sensors and the wires to the well casing. The embodiments described herein facilitate the sensors to be pumped down into the well much like a traditional wireline tool. However, the individual deployment shuttles allow fluid to flow through without creating undo pressure-drop, thereby allowing the system to remain in the well during various operation stages. Moreover, the embodiments described herein facilitate reducing the cost, time and complexity of deploying down hole sensing devices where an improve understanding of the sub-surface behavior is desirable. The deployment system includes a series of shuttles that are connected to one another via a wire. Sensors are located on each shuttle and/or along the wire. These deployment shuttles can be pumped into position and then expand or otherwise fit tightly against the walls of the well casing. The deployment shuttles also have the ability to contract or otherwise lose their tight fit with the well casing walls such that shuttles can be removed to allow for other tools to be inserted within the well casing or to be relocated to another well.

Also, during operation, the deployment system is deployed. The sensor or sensing wire is attached to each deployment shuttle either prior to sending the first deployment device into the well, or continuously as shuttles and the wire are inserted into the well. Fluid flow via a surface pump is used to generate pressure and push the deployment shuttles into the well. The bulk of the pressure can be generated at the first deployment shuttle, which includes an end cover or solid face. Other deployment shuttles are open allowing fluid to flow through. Proper tension is maintained on the wire connecting each of the deployment shuttles to one another. The portion of the wire taking the load may also include sensing elements. The embodiments described herein include a rotation device that is designed to address rotation of the deployment shuttle and/or wire as it is pumped into the well. The embodiments described herein may also resist rotation of the deployment shuttles and/or wire. The locations of the deployment shuttles can be determined by tracking the length of the wire that is taken from the wire spool, which can be mounted to a surface truck.

During operation, the deployment shuttles are "engaged" such that they fit tightly with the walls of the casing. Fluid flows from the pressure pumps on the surface, through the deployment shuttles and sensors, and into the formation through the perforations. Sensor data is collected at the surface for each sensor location, where data can be recorded and also displayed in a "frac van" for real-time stimulation monitoring and decision making. The deployment shuttles can be decoupled from the well casing and pulled out of the well via the wire.

The embodiments described herein collect down-hole data during hydraulic stimulation processes and hydrocarbon production processes. Down-hole data during these phases is valuable for improving understanding of subsurface behavior such as, but not limited to, "sweet spot" or natural fracture location, cluster-by-cluster fluid flow, stage-by-stage production, treating pressures, and stimulation efficiency. While conventional sensors and associated wires may need to be attached to the well casing prior to being inserted into the well, the embodiments described herein would be pumped into the well, much like a wireline tool, but can remain in the well during stimulation stages and production stages. The embodiments described herein allow for the sensors to be installed permanently or removed from the well should other processes need to be conducted or to allow the system to be reused at another location. Moreover, the embodiments described herein provide continuous data during well stimulation methods and hydrocarbon production method, while including high spatial resolution, such as by stage-by-stage, and/or cluster-by-cluster resolutions. Additionally, the location of sensors can be moved or reconfigured after initial placement in the well via the deployment shuttles.

A technical effect of the systems and methods described herein includes at least one of: (a) deploying sensors or cable-sensor systems in an oil well and/or gas well for extended periods of time during well stimulation periods and/or well production periods; (b) deploying sensors or cable-sensor systems in a well casing while allowing stimulation fluids and/or production fluids to flow within the well casing and reducing pressure drops within the fluids; (c) enhancing knowledge of sub-surface behavior of a geological formation; (d) sensing, collecting and reporting fluid data during fluid stimulation periods and/or fluid production periods; (e) securing sensors or cable—sensor systems for multiple well casings; and (f) decreasing design, installation, operational, maintenance, and/or replacement costs for a well site.

Processor is not limited to just those integrated circuits referred to in the art as a computer, but broadly refers to a microcontroller, a microcomputer, a programmable logic controller (PLC), an application specific integrated circuit, and other programmable circuits, and these terms are used interchangeably herein. In the embodiments described herein, memory may include, but is not limited to, a computer-readable medium, such as a random access memory (RAM), and a computer-readable non-volatile medium, such as flash memory. Alternatively, a floppy disk, a compact disc—read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor. The above examples are exemplary only, and thus are not intended to limit in any way the definition and/or meaning of the term processor.

Exemplary embodiments of a deployment system and methods for assembling a deployment are described herein. The methods and systems are not limited to the specific embodiments described herein, but rather, components of systems and/or steps of the methods may be utilized independently and separately from other components and/or steps described herein. For example, the methods may also be used in combination with other manufacturing systems and methods, and are not limited to practice with only the systems and methods as described herein. Rather, the exemplary embodiment may be implemented and utilized in connection with many other fluid and/or gas applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A sensor deployment system for positioning within a well casing, said sensor deployment system comprising:

a deployment shuttle comprising a first end, a second end, and an inner surface and an outer surface extending between said first end and said second end, said inner surface configured to define a channel between said first end and said second end;

a sleeve coupled to said outer surface and configured to move relative to the well casing; and a wire support coupled to said inner surface and extending into said channel.

2. The sensor deployment system of claim 1 further comprising an end cover coupled to at least one of said first end and said second end.

3. The sensor deployment system of claim 1 further comprising a communication wire coupled to said wire support.

4. The sensor deployment system of claim 1 further comprising a communication wire coupled to said wire support and comprising a sensor embedded therein.

5. The sensor deployment system of claim 1 further comprising a sensor coupled to said wire support.

6. The sensor deployment system of claim 1 further comprising a sensor coupled to said inner surface.

7. The sensor deployment system of claim 1 further comprising a sensor coupled to said wire support and comprising at least one of a pressure sensor, a temperature sensor, a flow sensor, a fluid composition sensor, an acoustical sensor, and a seismic sensor.

8. The sensor deployment system of claim 1 where said sleeve is configured to expand into a first position and is configured to retract to a second position.

9. The sensor deployment system of claim 1 where said sleeve comprises at least one of a bladder, a chemical degradation material, and a phase change material.

10. The sensor deployment system of claim 1 further comprising a communication wire coupled to said wire support and a strain sensor coupled to at least one of said communication wire and said wire support.

11. A sensor deployment system for monitoring a fluid flowing within a well casing, said sensor deployment system comprising:

a deployment shuttle comprising a first end, a second end, and an inner surface and an outer surface extending between said first end and said second end, said inner surface configured to define a channel between said first end and said second end;

a wire support coupled to said inner surface; and a sensor coupled to said wire support and configured to sense at least one characteristic of the fluid flowing within said channel.

12. The sensor deployment system of claim 11 wherein said wire support is configured to extend across said channel.

13. The sensor deployment system of claim 11 wherein said wire support is configured to suspend said sensor within said channel.

14. The sensor deployment system of claim 11 wherein said deployment shuttle is configured to allow flow of the fluid in opposite directions within the channel.

15. The sensor deployment system of claim 11 further comprising a computer device coupled to said deployment shuttle and configured to control at least one of a flow rate of the fluid, a pressure drop of the fluid, a position of said deployment shuttle within the well casing, a position of a sleeve coupled to said deployment shuttle, and a position of a communication wire coupled to said deployment shuttle.

16. The sensor deployment system of claim 11 further comprising a communication wire coupled to said wire support and a rotation device coupled to said communication wire and said wire support.

17. The sensor deployment system of claim 11 further comprising at least one of a fin, a perforated plate, and a cone coupled to said deployment shuttle.

18. A method of manufacturing a sensor deployment system for a well casing, said method comprising:

stabilizing a deployment shuttle having an inner surface, an outer surface, and a channel defined by the inner surface;

coupling a sleeve to the outer surface, the sleeve configured to move relative to the well casing; and coupling a wire support to the inner surface and extending the wire support within the channel.

19. The method of manufacturing of claim 18 further comprising coupling a communication wire to the wire support.

20. The method of manufacturing of claim 19 further comprising coupling a sensor to at least one of the wire support and the communication wire.

* * * * *